US012796755B2

(12) United States Patent
Falanco

(10) Patent No.: US 12,796,755 B2
(45) Date of Patent: Nov. 17, 2026

(54) WEARABLE GRIP ASSIST

(71) Applicant: Ingrid Falanco, Gilbert, AZ (US)

(72) Inventor: Ingrid Falanco, Gilbert, AZ (US)

( * ) Notice: Subject to any disclaimer, the term of this patent is extended or adjusted under 35 U.S.C. 154(b) by 604 days.

(21) Appl. No.: 18/367,385

(22) Filed: Sep. 12, 2023

(65) Prior Publication Data

US 2025/0082053 A1 Mar. 13, 2025

(51) Int. Cl.
*A41D 19/015* (2006.01)

(52) U.S. Cl.
CPC ..... *A41D 19/01547* (2013.01)

(58) Field of Classification Search
CPC ..... A41D 13/0575; A41D 13/081; A41D 13/085; A41D 19/002; A41D 19/0034; A41D 19/0037; A41D 19/0041; A41D 19/0093; A41D 19/01547; A41D 19/01552; A41D 19/01558; A41D 19/01564; A41D 20/00; A41D 20/005; A41D 2200/10; A41F 9/00; A41F 9/002; A41F 9/007; A41F 9/02; A41F 9/025; A45F 3/005; A45F 5/02; A45F 5/021; A45F 5/022; A45F 2003/001; A45F 2003/002; A45F 2003/006; A45F 2003/007; A45F 2003/008; A61B 5/6806; A61F 5/013; A61F 5/019; A63B 71/14; A63B 71/141; A63B 71/143; A63B 71/146; A63B 71/148; B26B 27/007; F41C 33/001
USPC ..... 294/25
See application file for complete search history.

(56) References Cited

U.S. PATENT DOCUMENTS 4,029,243 A * 6/1977 Zerobnick ..... A45F 3/00 224/664
4,069,954 A * 1/1978 Rauch ..... A63B 57/207 224/901.4
4,523,703 A * 6/1985 McKenna ..... A45F 3/00 224/660
5,163,591 A * 11/1992 Leiserson ..... A45F 5/021 224/663
5,240,158 A * 8/1993 Walsh ..... A45F 5/02 224/664
5,746,365 A * 5/1998 Scott ..... A45F 3/00 224/684
6,122,770 A * 9/2000 Mathison ..... B63C 9/32 224/232
6,182,872 B1 * 2/2001 Six ..... A45F 5/00 224/148.3
7,237,703 B1 * 7/2007 Nathan ..... A45F 3/16 224/148.7
10,775,142 B1 * 9/2020 Pineda ..... F42B 39/082
(Continued)

*Primary Examiner* — Joshua E Rodden
(74) *Attorney, Agent, or Firm* — Accelerate IP LLC

(57) ABSTRACT

Embodiments of the present disclosure may include a wearable grip assist for assisting a user in holding at least one object including an elastic band having a length, an axis, a first surface, a second surface, a first end, and a second end. Embodiments may also include at least one horizontal loop on the first surface of the band through which an object may be passed through the loop in an orientation essentially orthogonal to the axis of the band. Embodiments may also include at least one vertical loop on the second surface of the band through which an object may be passed through the loop in an orientation essentially parallel to the axis of the band. Embodiments may also include an adjustable connector coupling the first end to the second end and adjusting the length of the band.

7 Claims, 5 Drawing Sheets

(56) References Cited

U.S. PATENT DOCUMENTS

| | | | | |
|---|---|---|---|---|
| 2007/0170189 | A1* | 7/2007 | Carlile | A45F 5/02<br>220/739 |
| 2009/0095783 | A1* | 4/2009 | Price | A45F 3/00<br>224/660 |
| 2010/0193557 | A1* | 8/2010 | Clinton | A45F 3/02<br>224/625 |
| 2020/0355463 | A1* | 11/2020 | Piccioni | F41C 33/046 |

* cited by examiner

WEARABLE GRIP ASSIST

FIELD OF THE INVENTION

The present invention relates to wearable band designed for holding and carrying items. Specifically, the invention pertains to a novel band with integrated carrying features that allows the user to hold and stabilize personal items.

BACKGROUND OF THE INVENTION

Hand impairments can result from a variety of conditions, injuries, or age-related factors, affecting dexterity, grip strength, fine motor skills, and overall hand functionality. Individuals with hand issues often encounter difficulties in performing routine tasks, from grasping objects to using tools, which can significantly impact their quality of life. Roughly 61 million Americans have a disability that impacts their major life activities, many of which have limited to no hand function. Existing assistive solutions for hand issues primarily involve specialized tools or devices for specific tasks. While these devices offer targeted assistance for various activities, such as weightlifting, physical therapy, manual labor, or even everyday tasks that require a firm grip. However, these solutions may not always provide a holistic solution that addresses a wide range of activities requiring hand movement and coordination.

One common approach has been the use of gloves or straps that are worn on the hand or wrist. These devices often provide additional friction or mechanical advantage to improve the user's grip. However, these solutions often have limitations. For instance, gloves can be cumbersome and limit the user's tactile feedback, while straps can be uncomfortable and difficult to adjust.

Another example is found in U.S. Pat. No. 5,957,515 which describes a gripping assistance device for helping users to grip onto an object. This assistance device wraps around the user's wrist and has a connecting strip that is connected to a hand strap with rings. The rings allow the user to grip onto the object however the disadvantage of this device only allows the user to grip onto one size of object in one position and is big and bulky requiring the user to have another individual help when putting it on.

Other devices include wristbands with an ergonomic design that straps to a user's wrist with pockets that hold multiple items around the user's wrist. These types of enable users to store objects easily around the user's wrist. These pockets are usually small or compartments, but these designs may compromise comfort, style, or ease of access. These devices are strictly for storing things for the user to easily access and not for assisting in doing daily tasks like writing, putting on makeup or other tasks that require fine motor skills and does not allow the user to regain or enhance their hand functionality. In addition, many conventional grip assists do not provide adequate comfort or protection for the user. They may cause blisters, calluses, or other injuries, especially when used for extended periods. Some devices also have hard or sharp components that can cause discomfort or injury.

While existing solutions offer valuable contributions, challenges persist in terms of comfort, adaptability, affordability, and ease of use. The present invention aims to bridge this gap by introducing a wristband designed to assist and support individuals with hand issues, offering a versatile and integrated approach to enhance their daily lives.

BRIEF SUMMARY OF THE INVENTION

The invention pertains to a wearable grip assist designed to aid a user in holding at least one object. Embodiments of the present disclosure may include a wearable grip assist for assisting a user in holding at least one object including an elastic band having a length, an axis, a first surface, a second surface, a first end, and a second end. The wearable grip assist may include at least one horizontal loop on the first surface of the band through which an object may be passed through the loop in an orientation essentially orthogonal to the axis of the band. The wearable grip assist may include at least one vertical loop on the second surface of the band through which an object may be passed through the loop in an orientation essentially parallel to the axis of the band. The wearable grip assist may include an adjustable connector coupling the first end to the second end and adjusting the length of the band.

The at least one horizontal loop or the at least one vertical loop may include a first loop that may be larger than a second loop. The at least one vertical loop forms a zig-zag pattern along the second surface. In some embodiments, the first surface has a partially padded section. The partially padded section may be made from compressible foam. The at least one vertical loop may be stitched onto the second surface. The adjustable connector may be a ring with at least two loops. In some embodiments, the first end and the second end may be coupled to at least one of the two loops by stitching the first end to one side of the loop and stitching the second end to the other side of the loop.

The elastic band may be made from at least one of neoprene, nylon, polyester or spandex. In some embodiments, the at least one vertical loop may be about as thick as the elastic band. The at least one vertical loop may be a plurality of overlapping loops. In some embodiments, each loop has a bottom edge. The bottom edge of each vertical loop forms an acute angle with an edge of the elastic band. The at least one horizontal loop covers a first section of the length of the elastic band, the at least one vertical loop covers a second section of the length of the elastic band. The first section does not overlap with the second section. In some embodiments, the elastic band has a center that equidistant from the first end and the second end. The first section may be near each end of the elastic band and the second section may be near the center of the elastic band.

An advantage of the current invention is to provide a user with multiple options and loops to hold onto an object with or without the assistance of the user's hand or wrist.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Figure 1:
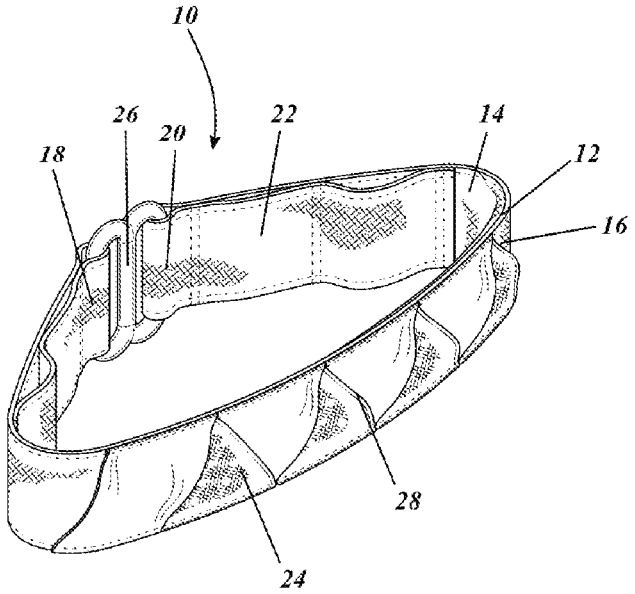
FIG. 1 is an isometric view of the wearable grip assist in accordance to one, or more embodiments.
Figure 2:
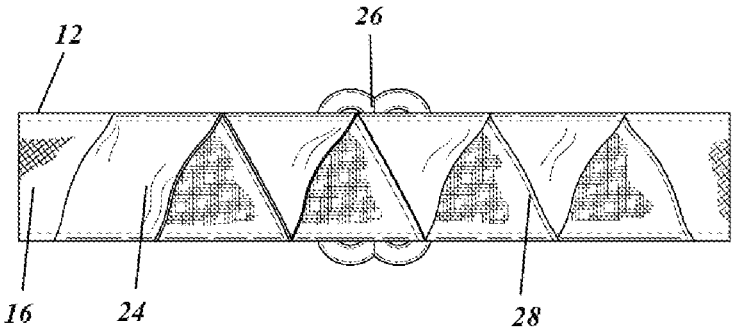
FIG. 2 is a front view of the wearable grip assist in accordance to one, or more embodiments.
Figure 3:
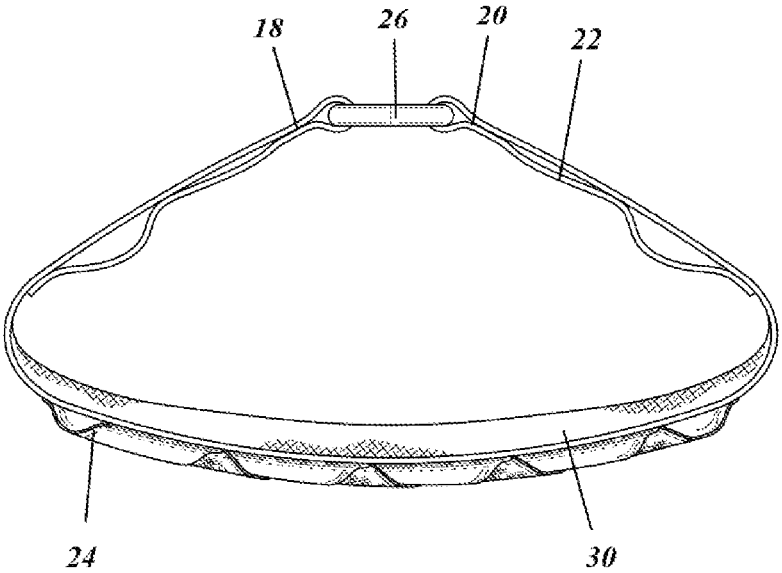
FIG. 3 is a top view of the wearable grip assist in accordance to one, or more embodiments.
Figure 4:
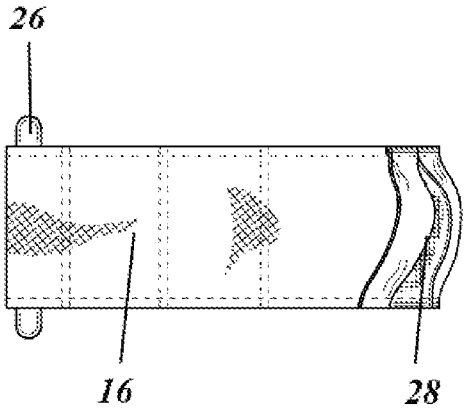
FIG. 4 is side view of the wearable grip assist in accordance to one, or more embodiments.
Figure 5:
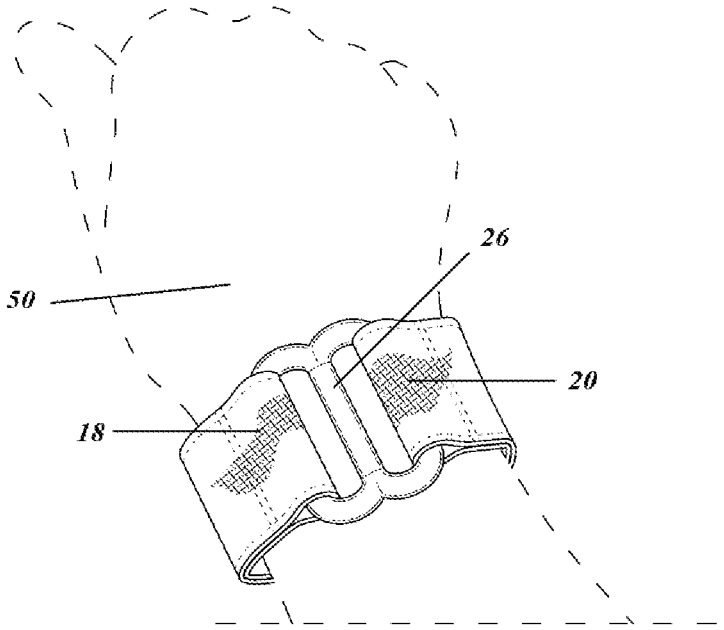
FIG. 5 is a view of the wearable grip assist on a user's wrist in accordance to one, or more embodiments.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Referring initially to FIGS. 1-5, a wearable grip assist 10 for assisting a user in holding at least one object 52 comprising a band 12 having an first surface 14 and an second surface 16 and a first end 18 and a second end 20. The wearable grip assist 10 can comprise a adjustable connector 26 wherein the adjustable connector can have more than one loop and can be such as for example, metal loop, buckle, slides, rings, slide bar, or the like. The first end 18 and the second end 20 can be coupled together by the adjustable connector 26 by such as, for example, stitching, rivets, fasteners, adhesive, hook and loop, or the like. The band 12 can be made from such as, for example, spandex, elastic jersey, stretch satin, mesh, fib knits, elastic woven material, athletic mesh, or the like.

In certain embodiments, the first end 18 and the second end 20 can be adjustably coupled together by the adjustable connector 26 wherein the first end and the second end can adjust to different user's size wrist and hands 50 wherein the first end and/or second end can have such as, for example, hook and loop fastener, buttons, or the like that allow the user to adjust the size of the band 12. The adjustable connector can adjust the length of the band to the user's needs and wrist and hand size.

In embodiments, the band 12 can have at least one horizontal loop 22 integrally formed to the first surface 14 through which an object 52 may be passed through the horizontal or vertical loop in an orientation essentially orthogonal to the axis of the band. The at least one horizontal loop 22 can be in the radial direction of the wearable grip assist 10. The at least one horizontal loop 22 can extend from the first end 18 and/or the second end 20 wherein the at least one loop can be integrally formed into the elastic band, or it can be attached to the elastic band by such as, for example, stitching, rivets, fasteners, adhesive, hook and loop, or the like. The at least one horizontal loop 22 can be different size loops as it extends from the first end 18 and/or the second end 20. The at least one horizontal loop 22 can partially or fully be around the first surface of the wearable grip assist. The varying size horizontal loop 22 can allow the user to insert and hold different size objects 52 within the loops keeping the objects securely fastened within the loops. In certain embodiments, the at least one horizontal loop 22 can be adjustable allowing the user to securely clamp the object 52 while within the loop. The at least one horizontal loop 22 can be removably or permanently attached to the first surface 14.

In embodiments, the second surface 16 can have at least one vertical loop 24 through which an object may be passed through the loop in an orientation essentially orthogonal to the axis of the band 12 wherein the vertical loop can be integrally formed or coupled to the second surface 16. The at least one vertical loop 24 can be coupled to the second surface by such as, for example, stitching, rivets, fasteners, adhesive, hook and loop, or the like. As each vertical loop 24 extends tangentially around the second surface 16 the vertical loop can be the same depth or it can be varying depths, such as, for example, the vertical loop can have one depth, a second vertical loop has another depth, the third vertical loop can have another depth, or the like and the zig-zag pattern forms the start of each vertical loop. The start of each zig-zag pattern 28 can have an edge that is such as, for example, selvage edge, hemmed edge, bound edge, rolled hem edge, knotted edge, or the like.

Figure 6:
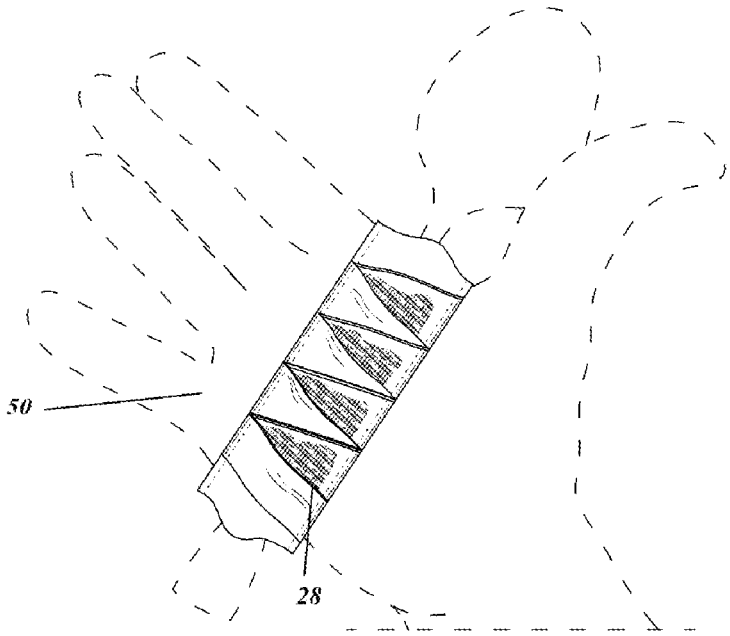
FIG. 6 is an example front view of the wearable grip assist holding an object on a user's hand in accordance to one, or more embodiments.
Figure 7:
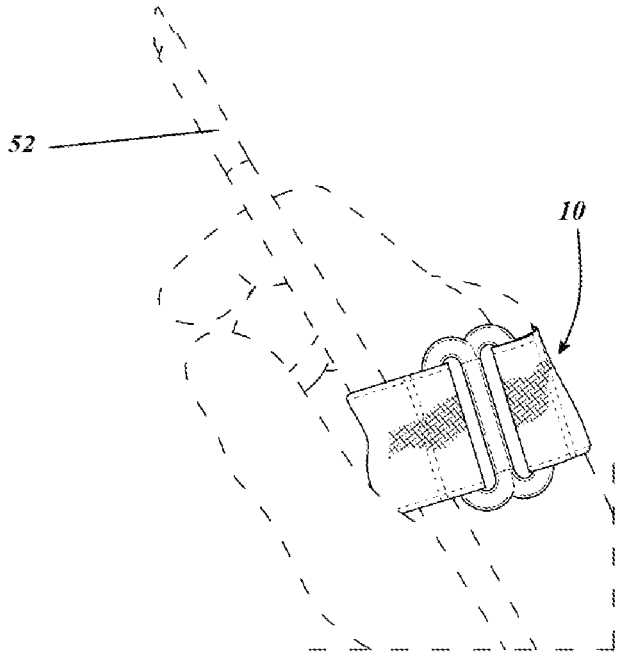
FIG. 7 is another example view of the wearable grip assist holding an object on a user's hand in accordance to one, or more embodiments.
Figure 8:
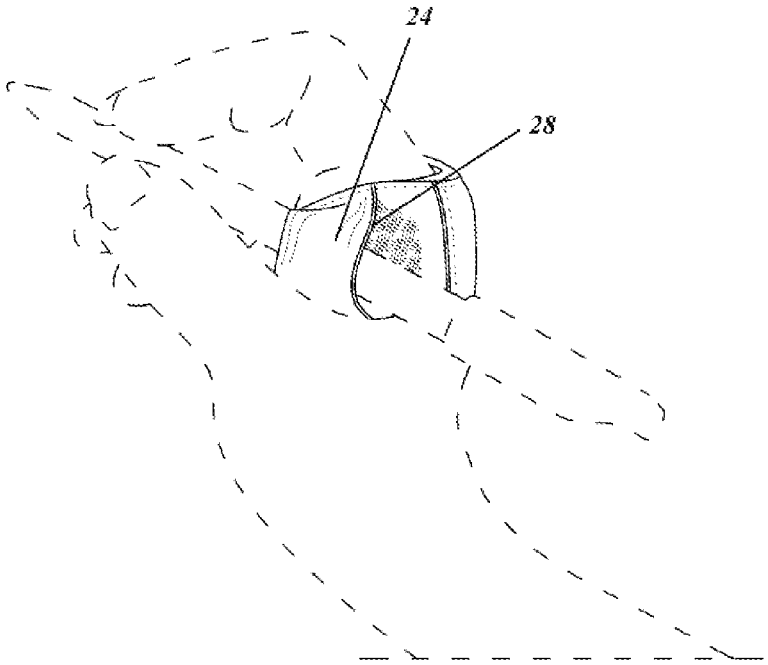
FIG. 8 is another example view of the wearable grip assist holding an object on a user's hand in accordance to one, or more embodiments.
Figure 9:
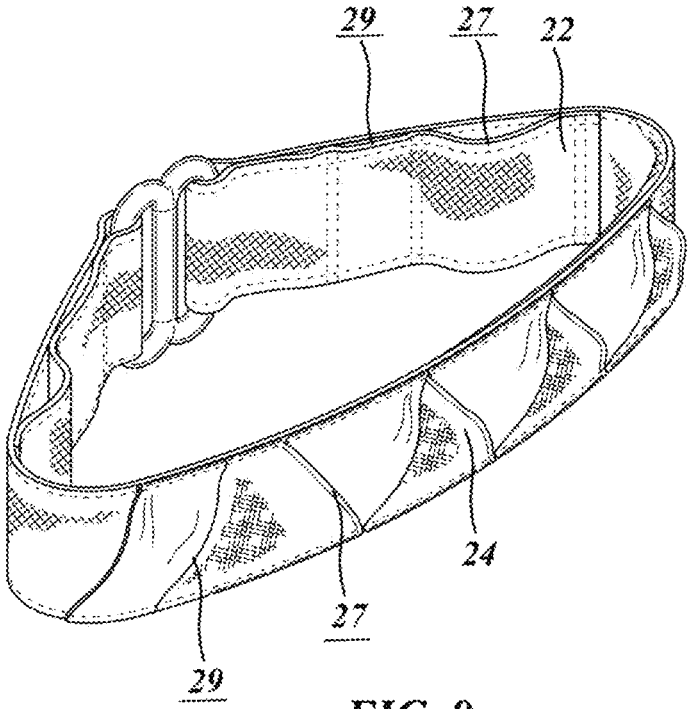
FIG. 9 is an isometric view of another embodiment of the wearable grip assist in accordance to one, or more embodiments.

The vertical loop 24 can be such as, for example, pockets, sleeves, thru holes, or the like wherein the sleeve can hold an object 52 tangentially to the wearable grip assist 10. The object 52 can be such as, for example, brushes, toothbrushes, pencil, pen, silverware, or the like. The wearable grip assist 10 can hold the object 52 in the palm of the hand through the zig-zag pattern 28 and vertical loop 24 as shown in FIG. 6 and FIG. 8. Additionally, the wearable grip assist 10 can hold the object 52 in at least one horizontal loop 22 as shown in FIG. 7. The vertical loop 24 and the horizontal loop 22 allow the user to easily attach the object 52 to the user without the user having to grip onto the object or grip tightly onto an object. In other embodiments, the at least one horizontal loop 22 or the at least one vertical loop 24 can have a first loop 27 that is larger than a second loop 29 as shown in FIG. 9.

In embodiments, the first surface 14 can have a padded section 30 that can partially or fully extends around the first surface 14. The padded section 30 can comprise of an inner layer of cushioning material, often composed of foam, batting, or a combination thereof. The padded section 30 can be made from such as, for example, viscoelastic foam, open-cell foam, neoprene foam, polyurethane foam, or the like. The padded section 30 can be covered by a material wherein the material can be such as, for example, cotton, polyester, silk, wool, nylon, acrylic or the like where this layer can provide a soft and supportive surface that contributes to a comfortable user experience. The cushioning material may have varying thicknesses or densities to accommodate different comfort requirements.

In embodiments, the at least one vertical loop 24 is about as thick as the elastic band 12. The at least one vertical loop 24 can have a plurality of overlapping loops, wherein each loop has a bottom edge and wherein the bottom edge of each vertical loop can form an acute angle with an edge of the elastic band. The at least one horizontal loop 22 covers a first section of the length of the elastic band 12, the at least one vertical loop 24 covers a second section of the length of the elastic band, and wherein the first section does not overlap with the second section. The elastic band 12 can have a center that equidistant from the first end 18 and the second end 20 wherein the first section is near each end of the elastic band and the second section is near the center of the elastic band.

In certain embodiments, the wearable grip assist 10 can be manufactured in different sections wherein the section can be the elastic sections on the first end 18 and the second end 20 and the padded section 30 wherein each section can be coupled together by such as, for example, stitching, rivets, fasteners, adhesive, hook and loop, or the like. Adjacent to the padded area 30, the non-padded region can comprise an elastic material which can maintain the overall structure, aesthetics, and functionality of the article while seamlessly transitioning into the padded area.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. A wearable grip assist for assisting a user in holding at least one object comprising:

an elastic band having a length, an axis, a first surface, a second surface, a first end, and a second end;

at least one horizontal loop on the first surface of the band through which at least one object is configured to be passed through the loop in an orientation essentially orthogonal to the axis of the band, the at least one horizontal loop covering a first section of the length of the elastic band;

at least one vertical loop on the second surface of the band through which at least one object is configured to be passed through the loop in an orientation essentially parallel to the axis of the band, the at least one vertical loop covering a second section of the length of the elastic band, wherein the first section does not overlap with the second section;

wherein the at least one vertical loop comprises a plurality of overlapping loops that form a zig-zag pattern along the second surface, each of the plurality of overlapping loops having a bottom edge that forms an acute angle with an edge of the elastic band;

an adjustable connector coupling the first end to the second end and adjusting the length of the band, wherein the adjustable connector is a ring with at least two loops, wherein the first end and the second end are coupled to one of the two loops by stitching the first end to one side of the loop and stitching the second end to the other side of the loop; and wherein the elastic band has a center equidistant from the first end and the second end, wherein the first section comprises a portion near each of the first end and the second end of the elastic band, and wherein the second section is near the center of the elastic band.

2. The wearable grip assist according to claim 1, wherein the at least one horizontal loop or the at least one vertical loop comprises a first loop that is larger than a second loop.

3. The wearable grip assist according to claim 1, wherein the first surface has a partially padded section.

4. The wearable grip assist according to claim 3, wherein the partially padded section is made from compressible foam.

5. The wearable grip assist according to claim 1, wherein the at least one vertical loop is stitched onto the second surface.

6. The wearable grip assist according to claim 1, wherein the elastic band is made from at least one of neoprene, nylon, polyester or spandex.

7. The wearable grip assist according to claim 1, wherein the at least one vertical loop is about as thick as the elastic band.

* * * * *